US011414286B1

(12) United States Patent
Epstein

(10) Patent No.: US 11,414,286 B1
(45) Date of Patent: Aug. 16, 2022

(54) DEVICE FOR MOUNTING, HOLDING, AND UNSPOOLING A PACKAGING FILM ROLL, USED IN A HORIZONTAL, FORM, FILL, AND SEAL PACKAGING MACHINE

(71) Applicant: Moshe Epstein, Northbrook, IL (US)

(72) Inventor: Moshe Epstein, Northbrook, IL (US)

( * ) Notice: Subject to any disclaimer, the term of this patent is extended or adjusted under 35 U.S.C. 154(b) by 0 days.

(21) Appl. No.: 17/705,361

(22) Filed: Mar. 27, 2022

(51) Int. Cl.
*B65H 19/12* (2006.01)
*B65H 16/02* (2006.01)

(52) U.S. Cl.
CPC ..... *B65H 16/02* (2013.01); *B65H 19/12* (2013.01); *B65H 2405/452* (2013.01); *B65H 2801/81* (2013.01)

(58) Field of Classification Search
CPC ..... B65H 16/02; B65H 19/12; B65H 19/123; B65H 2405/452; B65H 2801/81
See application file for complete search history.

(56) References Cited

U.S. PATENT DOCUMENTS 4,438,554 A * 3/1984 Sciola ..... B65H 16/02 242/596.5
4,958,170 A * 9/1990 Schwartz ..... B65H 16/02 396/650
5,699,979 A * 12/1997 Spada ..... B65H 16/02 242/563.2
6,355,139 B1 * 3/2002 Baggot ..... B65H 16/103 242/545.1
6,440,268 B1 * 8/2002 Baggot ..... B65H 16/10 162/120
8,002,215 B2 * 8/2011 Repp ..... B65H 19/12 242/596.7
8,870,366 B2 * 10/2014 Akatsu ..... B65H 16/103 347/104
10,654,675 B1 * 5/2020 Chen ..... B65H 19/305

* cited by examiner

*Primary Examiner* — Sang K Kim
(74) *Attorney, Agent, or Firm* — Steven Ivy P.C.

(57) ABSTRACT

Disclosed is a device for mounting and unspooling a packaging film roll. The device is attached to a horizontal, form, fill, and seal packaging machine. The film is used to form the bottom portion of packages made by the machine. The device comprises of a shaft, sleeve subassembly, air chuck, adjuster subassembly, internal and external housing subassemblies, brake, and film roller subassembly. The sleeve subassembly along with the chuck is used for holding the packing film roll. The adjuster subassembly is used to aligning the packaging film roll with the machine's conveying chain. The conveying chain pulls the film into the machine, resulting in unspooling of the packaging film roll. The brake is used to controllably stop and restart the unspooling of the film roll, which allows the film roller subassembly to keep the packing film entering the machine is flat and properly tensioned.

20 Claims, 14 Drawing Sheets

SECTION A - A

DEVICE FOR MOUNTING, HOLDING, AND UNSPOOLING A PACKAGING FILM ROLL, USED IN A HORIZONTAL, FORM, FILL, AND SEAL PACKAGING MACHINE

FIELD OF THE INVENTION

The present invention relates to the general field of packaging machines, and tooling used in automated, horizontal, packaging machines.

BACKGROUND OF THE INVENTION

Food packaging machines utilize, thin packaging film to form packages, which in the process of forming are also filled with food. The film is typically supplied to the conveying system of the machine from a large roll, attached to the machine via a roll mount station, which is unspooled throughout the operation of the machine.

A popular version of a packing machine is a horizontal, form, fill and seal packaging machine. As the name implies, in this type of a machine the process of forming the packages is progressing horizontally. This is done by using a conveying system, which utilizes a chain capable of gripping, pulling and thereby unspooling of the packing from a large roll of packaging film. Once the film is unspooled and in a horizontal position, the chain pulls the film between various functional stations, where packages are formed, filled, and subsequently sealed, thereby completing the packaging process.

The commercially-available horizontal, form, fill and seal packaging machines utilize packaging fill roll mount stations offering subpar performance and durability. More specifically, there are two distinct issues that cause these stations to underperform: (1) unreliable braking system (used for stopping rotation of the packing firm roll); and (2) unstable bearing mechanism (used for holding and enabling rotation of a shaft carrying the packaging film roll).

The present invention resolves these issues by redesigning the bearing mechanism, and by replacing the braking system. Unlike the typical machine, which houses the film feeding station within the frame of the machine, the present invention houses some components within the frame of the machine, and some outside the machine's frame. More specifically, the present invention introduces a new external bearing block, and incorporates a different brake system, all of which are disposed outside the frame of the machine wall.

The previous brake designs utilized a braking pad that acted like a pneumatic cylinder, having a friction pad pushing on a rotating metal disc. The new brake is more effective, much more durable, and it is very accessible, and therefore easily maintained. It incorporates a new braking system, which is air engaged, and shaft mounted, unlike the previous design.

The new design also incorporates two new bearing blocks, internal (housed within the frame of the machine), and external (housed within the frame of the machine). This design provides for much greater separation between the bearings, used for holding and enabling rotation of a shaft on which the packaging film roll is mounted. The enlarged distance between the bearings reduces the radial load impacting the shaft, thereby reducing the likelihood of failures caused by the bottom packaging film feeding station.

BRIEF SUMMARY OF THE INVENTION

The following information is intended to be a brief summary of the invention, and as such, said information shall not be used as the means of limiting the scope of the invention:

Disclosed is a device for mounting, holding, and unspooling a packaging film roll, used in a horizontal, form, fill, and seal packaging machine ("roll mount"). The roll mount comprises of the following components and subassemblies: shaft (for enabling rotation of the packaging film roll), sleeve subassembly (for holding the packaging film roll), air chuck (for releasably-locking the packaging film roll to the sleeve subassembly), adjuster subassembly (for adjusting the positioning of the sleeve subassembly in relation to the conveying chain, and for locking the film roll in place), internal and external housing subassemblies (for housing two bearings sufficiently separated to reduce the radial load impacting the shaft), brake (for controlling the rotation of the shaft), and film roller subassembly (for tensioning and guiding into the machine the packing film unspooled form the packaging film roll). The roll mount is attached to the bottom packaging film feeding station of the machine. The film feeding station is typically the first functional station on the machine, and its purpose is to feed into the machine the packaging film which is used to form the bottom portion of packages made by the machine. More specifically, by using the adjuster subassembly the packaging film roll position is adjusted and aligned with the conveying chain. The film is gripped by the conveying chain and is pulled continuously into the machine, resulting in unspooling of the packaging film roll. The brake is used to controllably stop and restart the unspooling of the film roll. The control of the roll, allows the dancer arm of the film roller subassembly to keep constant pressure on the unspooling film. The applied pressure ensures that the packing film entering the machine is flat and properly tensioned, which in turn leads to formation of flawless packages.

BRIEF DESCRIPTION OF THE DRAWINGS

The components shown in the drawings are not to scale. In the interest of clarity, some of the components might be shown in a generalized form and could be identified utilizing commercial designations. All components, including its essential features, have been assigned reference numbers that are utilized consistently throughout the descriptive process outlined herein.

DESCRIPTIVE KEY

Present Invention

100—Device for mounting, holding, and unspooling a packaging film roll, used in a horizontal, form, fill, and seal packaging machine
110—shaft
- 111—shaft first end
- 112—shaft roll section
- 113—shaft bearing section
- 114—shaft second end
- 115—threaded hole
- 116—two guiding pins

120—sleeve subassembly
- 121—sleeve first end
- 122—sleeve midsection
- 123—sleeve second end
- 124—stopper disc
- 125—adjuster grooves
- 126—bearing grooves
- 127—sleeve bearing/pocket
- 128—retaining rings

129—two guiding slots
130—air chuck (air chuck or similarly functioning device)
140—adjuster subassembly
141—threaded rod
142—bearing ring
143—adjustment knob
144—locking knob
150—internal housing subassembly
151—internal housing shaft hole
152—internal housing bearing pocket
153—internal housing bearing
154—clearance holes
155—bearing retaining cover
156—counterbored holes
157—seal retaining pocket
158—lip seal
160—external housing subassembly
161—external housing shaft hole
162—external housing bearing pocket
163—external housing bearing
164—bearing retaining collar
165—wall flange with threaded holes
166—brake flange with threaded holes
170—brake (air engaged, shaft mounted, straight bore, flange mountable)
180—film roller subassembly
181—arm mounting unit
182—dancer arm
183—proximity switch
184—dancer roller
185—stabilizing roller
186—feeding roller
200—packaging film roll (or packaging film spool)
201—packaging film
300—machine (horizontal, form, fill, and seal packaging machine)
301—machine wall
302—conveyor side machine wall
303—external side machine wall
310—bottom packaging film feeding station (present invention location)
320—conveying chain
330—bottom package forming station
340—product fill station
350—top packaging film feeding station
360—top package sealing station
370—package perforating station
380—power and control station

DETAILED DESCRIPTION OF THE PREFERRED EMBODIMENT

Figure 1:
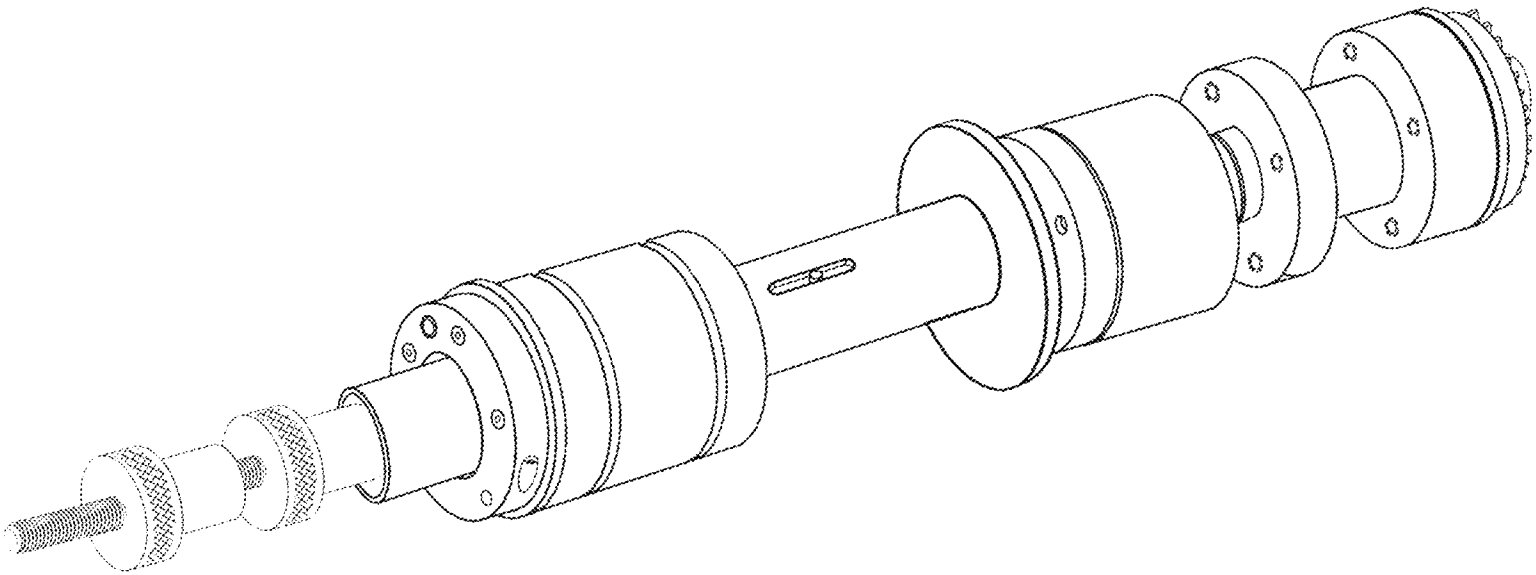
FIG. 1 is a perspective view of a device for mounting, holding, and unspooling a packaging film roll, used in a horizontal, form, fill, and seal packaging machine ("roll mount"); in accordance with an exemplary embodiment of the present invention.

The following description references to the above-defined drawings and represents only an exemplary embodiment of the invention. It is foreseeable, and recognizable by those skilled in the art, that various modifications and/or substitutions to the invention could be implemented without departing from the scope and the character of the invention:

As shown in FIG. 1, disclosed is a device (the "roll mount") 100 for mounting, holding, and unspooling a packaging film roll 200, used in a horizontal, form, fill, and seal packaging machine 300 (the "machine").

A typical, fully functional machine 300 (shown in FIG. 3), may incorporate the following working stations: bottom package forming station 330, product fill station 340 top packaging film feeding station 350, top package sealing station 360, package perforating station 370, power and control station 380. The above-defined stations are interconnected via a conveying chain 320, having a machine wall 301 disposed on either side it; wherein the machine wall 301 comprises of a conveyor side machine wall 302, and an external side machine wall 303.

Figure 3:
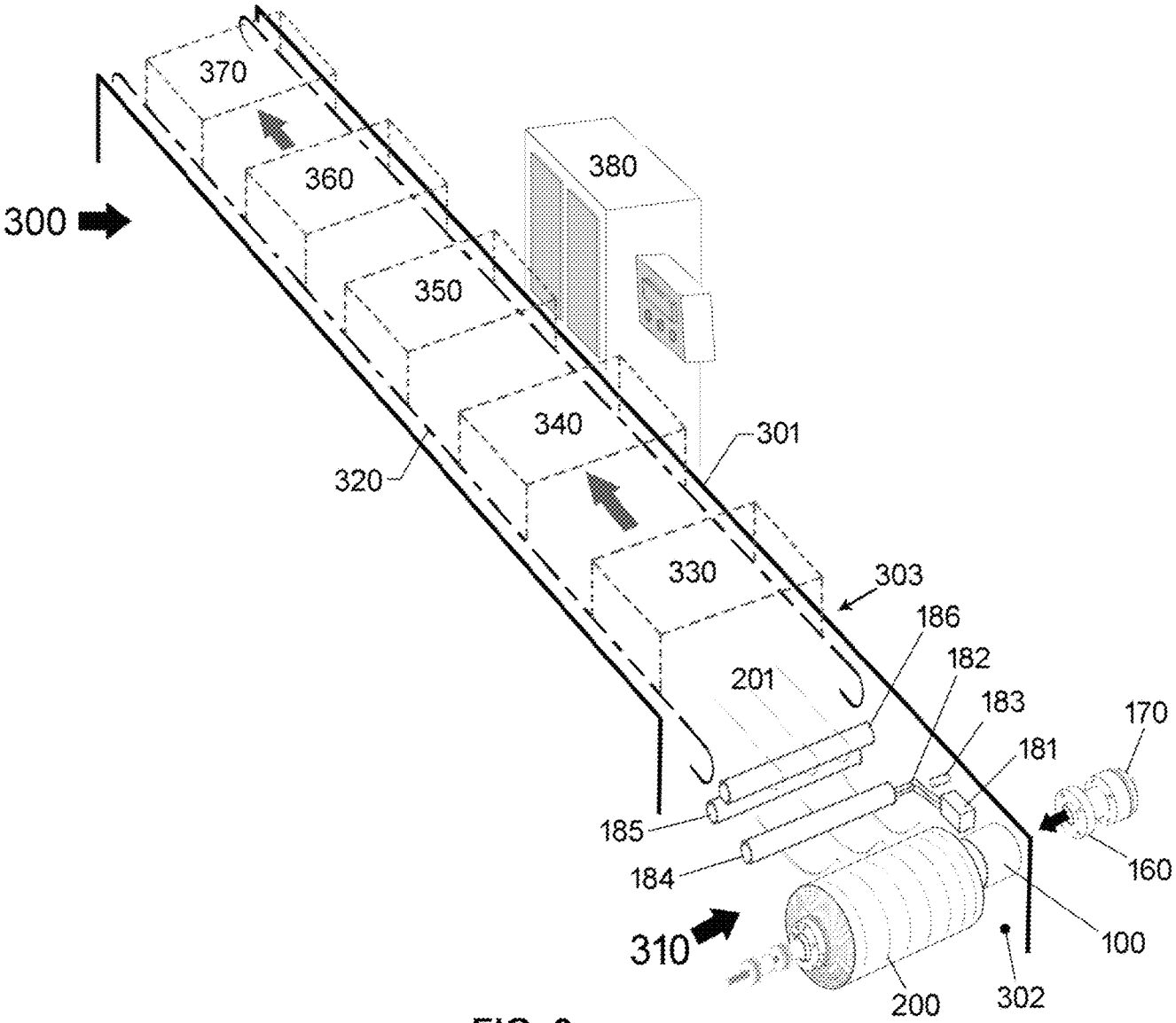
FIG. 3 is a perspective view of a horizontal, form, fill and seal packaging machine (prior art) designed to show the location of the bottom packaging film feeding station where the roll mount is situated; the figure also shows the positioning of the film roller subassembly, including the locations of the following components: (1) arm mounting unit; (2) dance arm; (3) proximity switch; (4) dancer roller; (5) stabilizing roller; and (6) feeding roller; in addition, to the above-defined elements, the figure also shows locations of other components and functional stations used by the machine, and their location relative to the roll mount, including: (7) conveying chain; (8) machine wall; (9) conveyor side machine wall; (10) external side machine wall; (11) bottom packaging forming station; (12) product fill station; (13) top packaging film feeding station; (14) top package sealing station; (15) package perforation station; and (16) power/control station; in accordance with an exemplary embodiment of the present invention.
Figure 4:
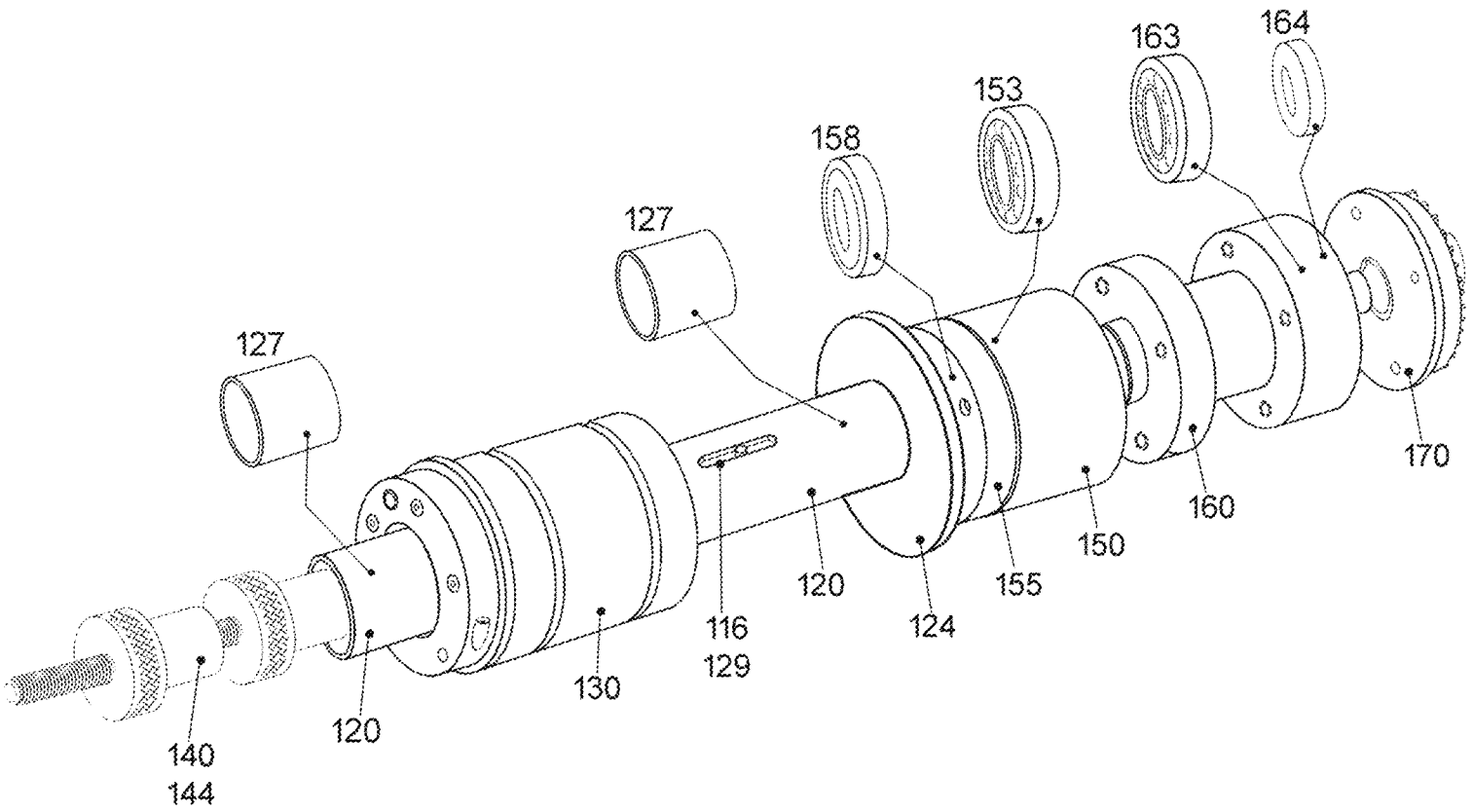
FIG. 4 is a perspective view of the fully-assembled roll mount, showing the locations of friction-reducing components, including: (1) sleeve bearings (situated inside the sleeve subassembly); (2) lip seal (situated inside the bearing retaining cover); (3) internal housing bearing (situated inside the internal housing subassembly); (4) bearing retaining collar (also disposed inside the internal housing subassembly; in accordance with an exemplary embodiment of the present invention.

As shown in FIG. 3, the film feeding station 310 is typically the first functional station in the machine 300, and its purpose is to feed into the machine 300 the packaging film 201, which is utilized to form the bottom portion of the packages made by the machine 300. In fact, the roll mount 100 is the primary component of the bottom packaging film feeding station 310 of the machine 100.

As shown in FIGS. 2, 4, 5, and 7, the roll mount 100 comprises of the following primary components and subassemblies: shaft 110, sleeve subassembly 120, air chuck 130, adjuster subassembly 140, internal housing subassembly 150, bearing retaining cover 155, external housing sub assembly 160, brake 170, and film roller subassembly 180.

As shown in FIGS. 2, 4, 5, 7, and 8, the shaft 110 is utilized for holding and for functionally connecting all the components and subassemblies of the roll mount 100. The shaft further comprises of a shaft first end 111, shaft roll section 112, shaft bearing section 113, shaft second end 114, threaded hole 115 and two guiding pins 116.

Figure 2:
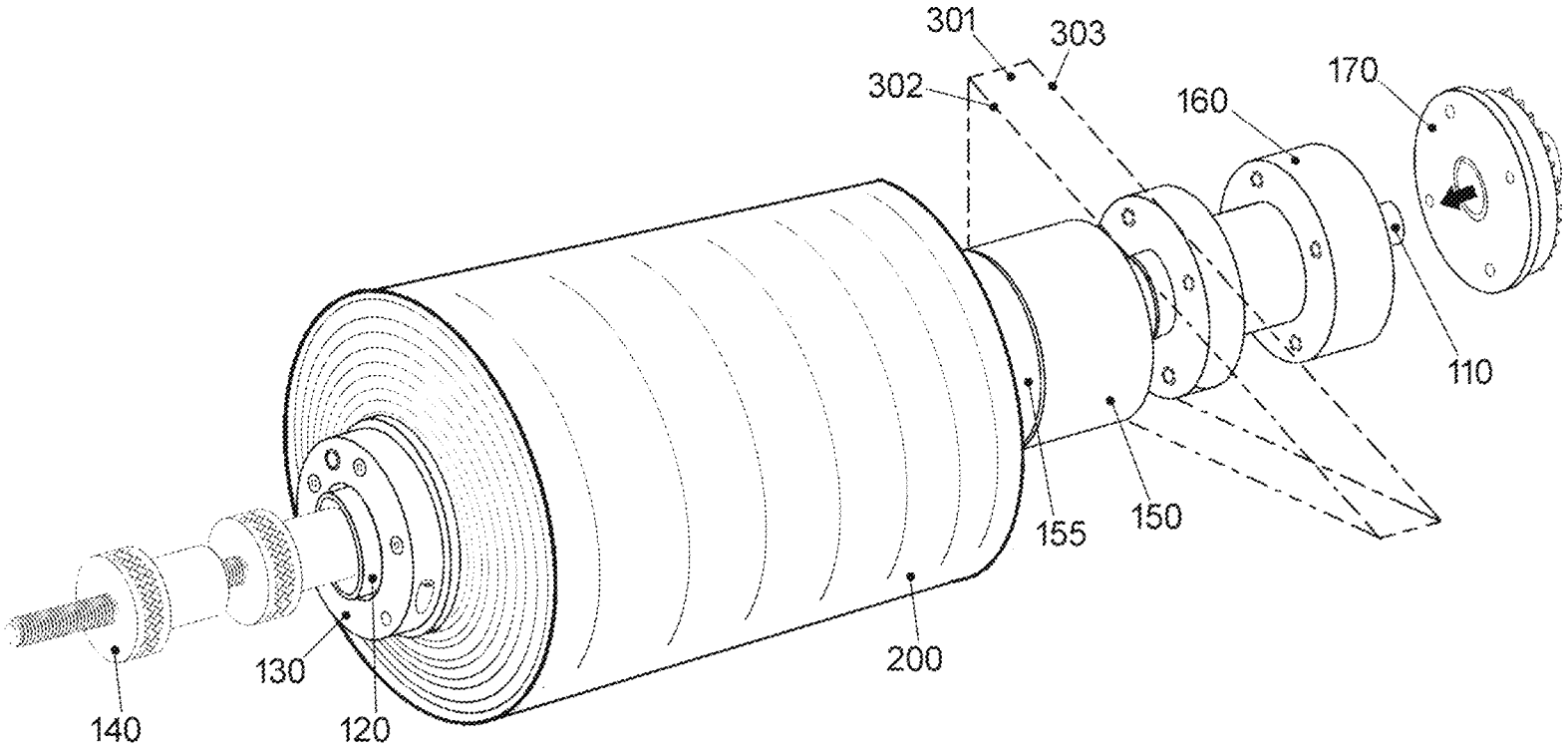
FIG. 2 is a perspective view of the roll mount assembly, showing the fully-assembled components and subassemblies, including: (1) adjuster subassembly; (2) sleeve subassembly (mostly abstracted by the packaging film roll); (3) air chuck; (4) packaging film roll; (5) bearing retaining cover; (6) internal housing subassembly; (7) shaft; and (8) brake; wherein the figure also shown the positioning of (9) the machine wall (represented by a broke line triangle), including locations of (10) the conveyor side machine wall (holding the internal housing sub assembly), and (11) the external side machine wall (holding the external housing subassembly); in accordance with an exemplary embodiment of the present invention.
Figure 5:
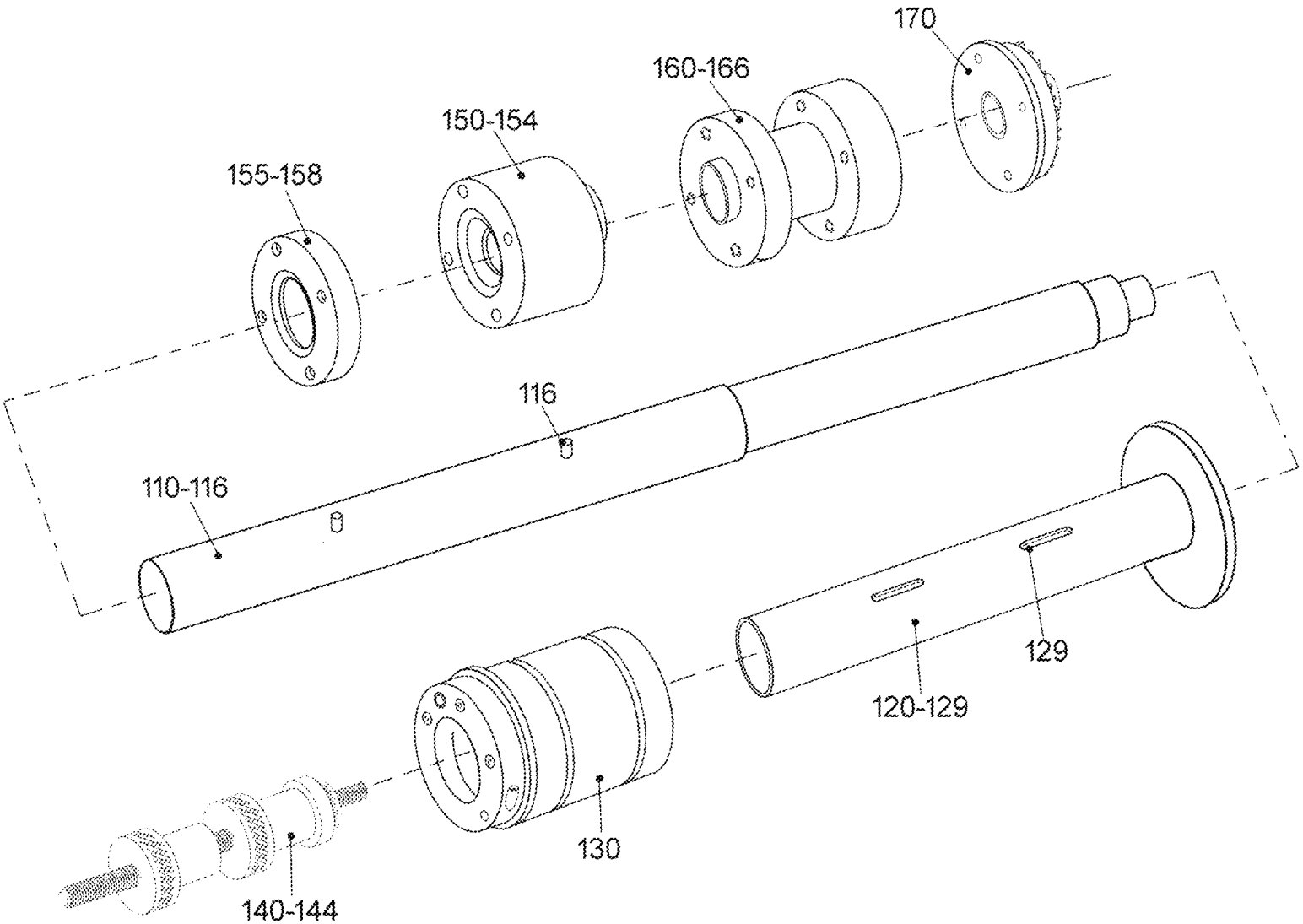
FIG. 5 is an exploded view of the roll mount, showing all the primary components and subassemblies, including: (1) adjuster subassembly; (2) air chuck; (3) sleeve subassembly; (4) shaft; (5) bearing retaining cover; (6) internal housing subassembly; (7) external housing subassembly; and (8) air brake; in accordance with an exemplary embodiment of the present invention.
Figure 6:
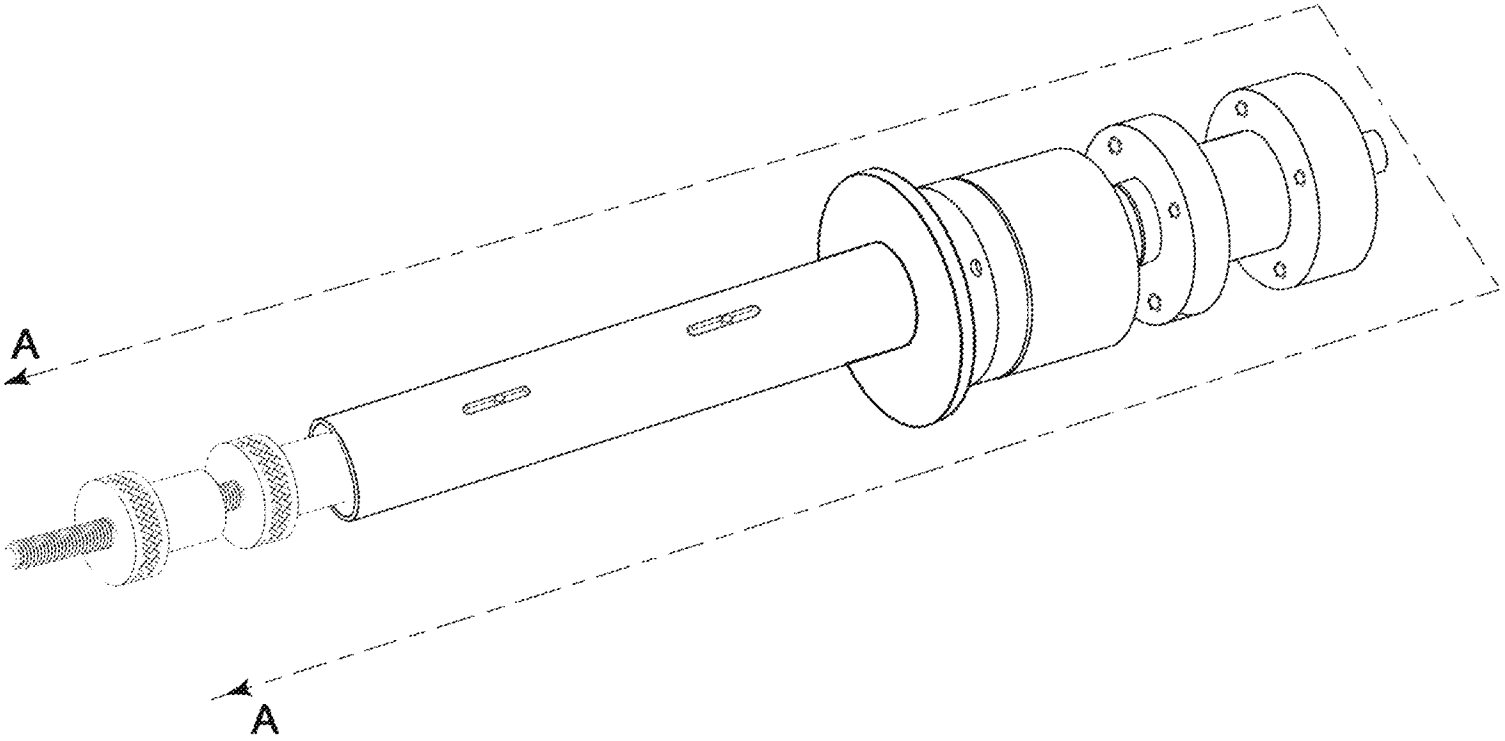
FIG. 6 is a perspective view of roll mount (assembly excludes the air chuck, and the brake) showing the positioning of the sectional view presented in FIG. 7; in accordance with an exemplary embodiment of the present invention.
Figure 7:
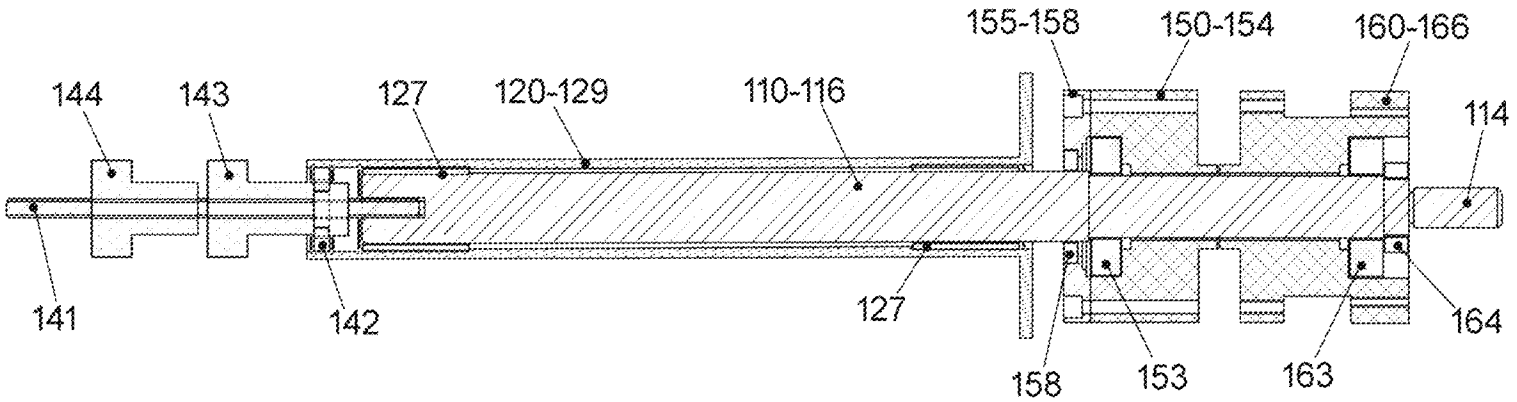
FIG. 7 is a section view (Section A-A) of the of the roll mount, using leaders and descriptive key numbers to show the positioning of the primary components and subassemblies, including: (1) adjuster subassembly; (2) air chuck; (3) sleeve subassembly; (4) shaft; (5) bearing retaining cover; (6) internal housing subassembly; (7) external housing subassembly; and (8) air brake; in accordance with an exemplary embodiment of the present invention.
Figure 9:
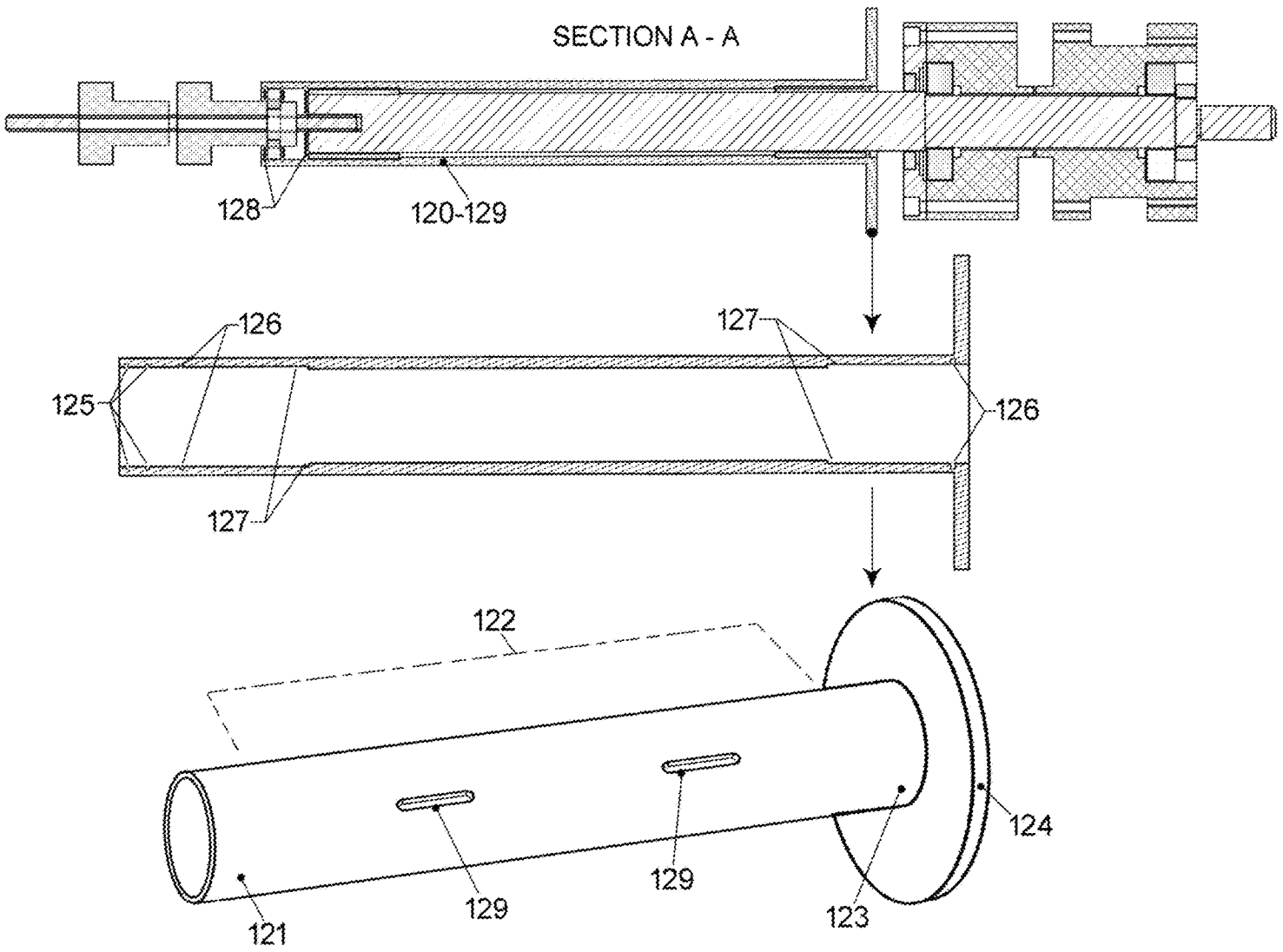
FIG. 9 shows (1) the section view (Section A-A) of the of the roll mount; (2) section view of the sleeve subassembly; and (3) perspective view of the sleeve subassembly, wherein leaders and descriptive key numbers are used to further outline its components, including: (a) sleeve first end; (b) sleeve midsection; (c) sleeve second end; (d) stopper disc; (e) adjuster grooves; (f) bearing grooves; (g) sleeve bearing pocket (actual bearing not shown); and (h) two guiding slots; in accordance with an exemplary embodiment of the present invention.

As shown in FIG. 2, the sleeve subassembly 120, with the help of an air chuck 130, is used for holding the packaging film roll 200 in place, as shown in FIGS. 5, 7 and 9. The sleeve subassembly 120 is also used for enabling the horizontal location adjustment of the packaging film roll 200. The sleeve subassembly 120 comprises of a sleeve first end 121, a sleeve midsection 122, a sleeve second end 123, a stopper disc 124, adjuster grooves 125, bearing grooves 126, sleeve bearings 127, retaining rings 128, and two guiding slots 129.

As shown in FIGS. 2, 5, 7 and 10, the adjuster subassembly 140 is used for adjusting the positioning and for locking in place the sleeve subassembly 140, along with the packaging film roll 200 attached thereto. The adjuster subassembly 140 comprises of a threaded rod 141, a bearing ring 142, an adjustment knob 143, and a locking knob 144.

Figure 11:
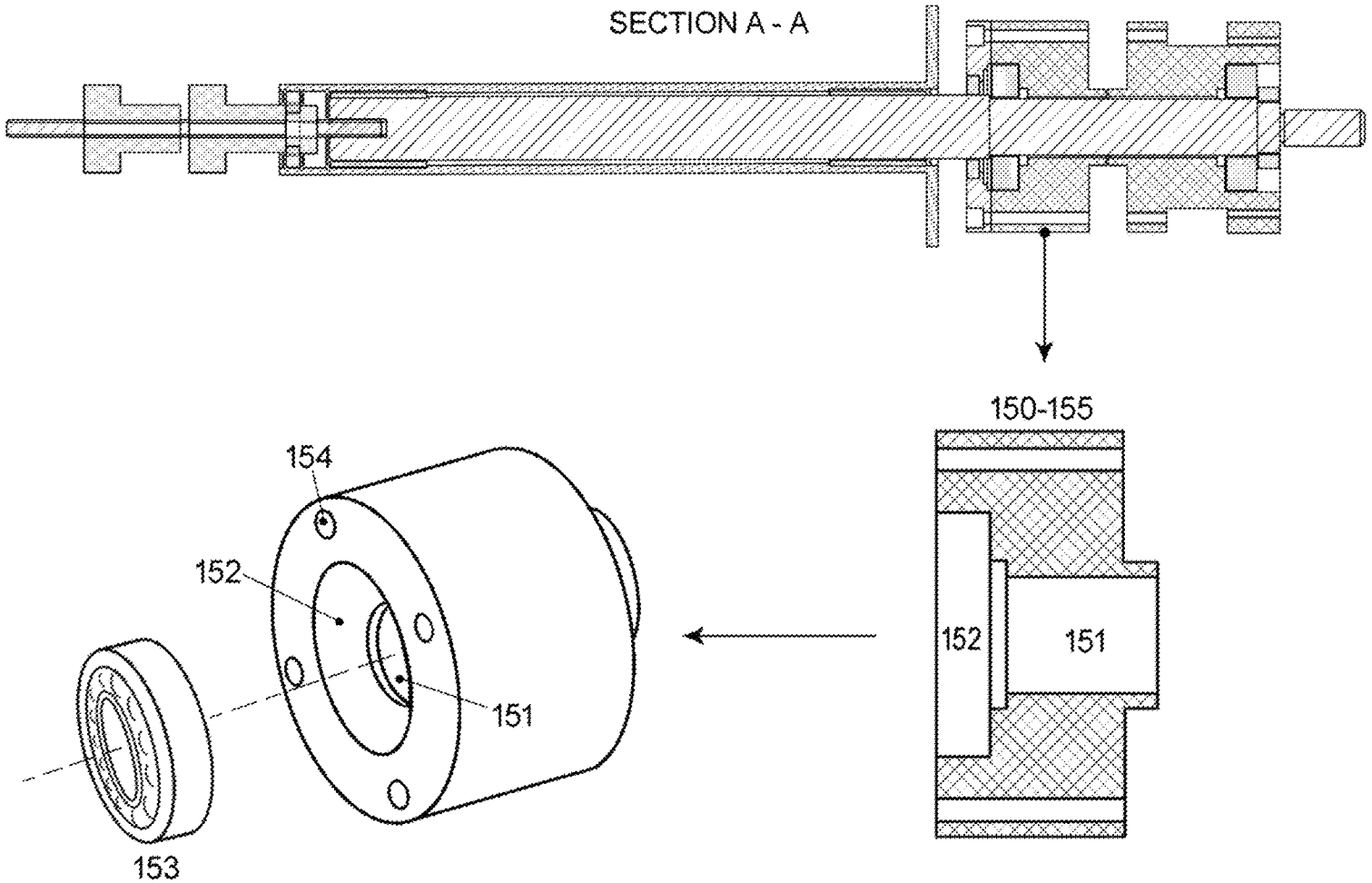
FIG. 11 shows (1) a sectional view (Section A-A) of the of the roll mount; (2) section view of the internal housing subassembly; and (3) a perspective view of the internal housing subassembly, wherein leaders and descriptive key numbers are used to further outline its components, including: (a) internal housing shaft hole; (b) internal housing bearing pocket; (c) internal housing bearing; and (d) clearance hole; in accordance with an exemplary embodiment of the present invention.
Figure 12:
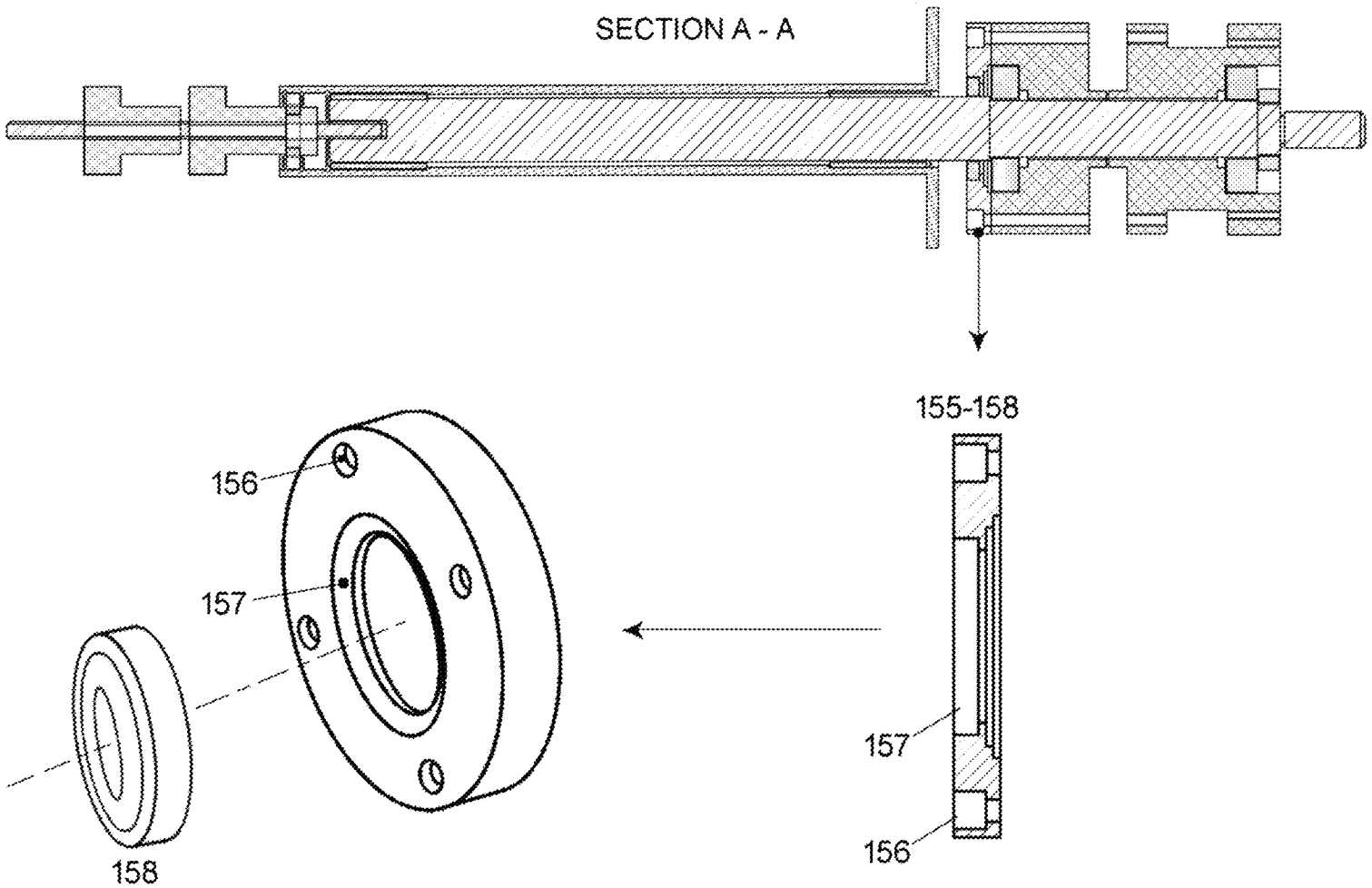
FIG. 12 shows (1) a sectional view (Section A-A) of the of the roll mount; (2) section view of the bearing retaining cover; and (3) a perspective view of the bearing retaining cover, wherein leaders and descriptive key numbers are used to further outline its components, including: (a) counterbored holes; (b) seal retaining pocket; and (c) lip seal; in accordance with an exemplary embodiment of the present invention.

As shown in FIGS. 2, 5 and 11, the internal housing subassembly 150, comprises of an internal housing shaft hole 151, internal housing bearing pocket 152, internal housing bearing 153, and clearance holes 154. The bearing retaining cover 155, shown in FIG. 12, is attached to internal housing subassembly 150, and serves as a cover for the internal housing bearing 153.

As shown in FIGS. 2, 5, 7 and 13, the external housing subassembly 160, comprises of an external housing shaft hole 161, external housing bearing pocket 162, external housing bearing 163, bearing retaining collar 164, wall flange with threaded holes 165, and brake flange with threaded holes 166. Attached to the external housing subassembly 160 is a brake 170. As shown in FIG. 3, the film roller subassembly 180 comprises of an arm mounting unit 181, dancer arm 182, proximity switch 183, dancer roller 184, stabilizing roller 185, and feeding roller 186.

The process of attaching the roll mount 100 to the machine 300, can be subdivided into the following five steps: (1) attachment of the internal, external housing subassemblies and the shaft; (2) attachment of the sleeve subassembly; (3) attachment of the air chuck and the adjuster subassembly; (4) attachment of the brake; and (5) connection of the roll mount to the conveying chain.

(1) Attachment of the Internal, External Housing Subassemblies and the Shaft.

Figure 14:
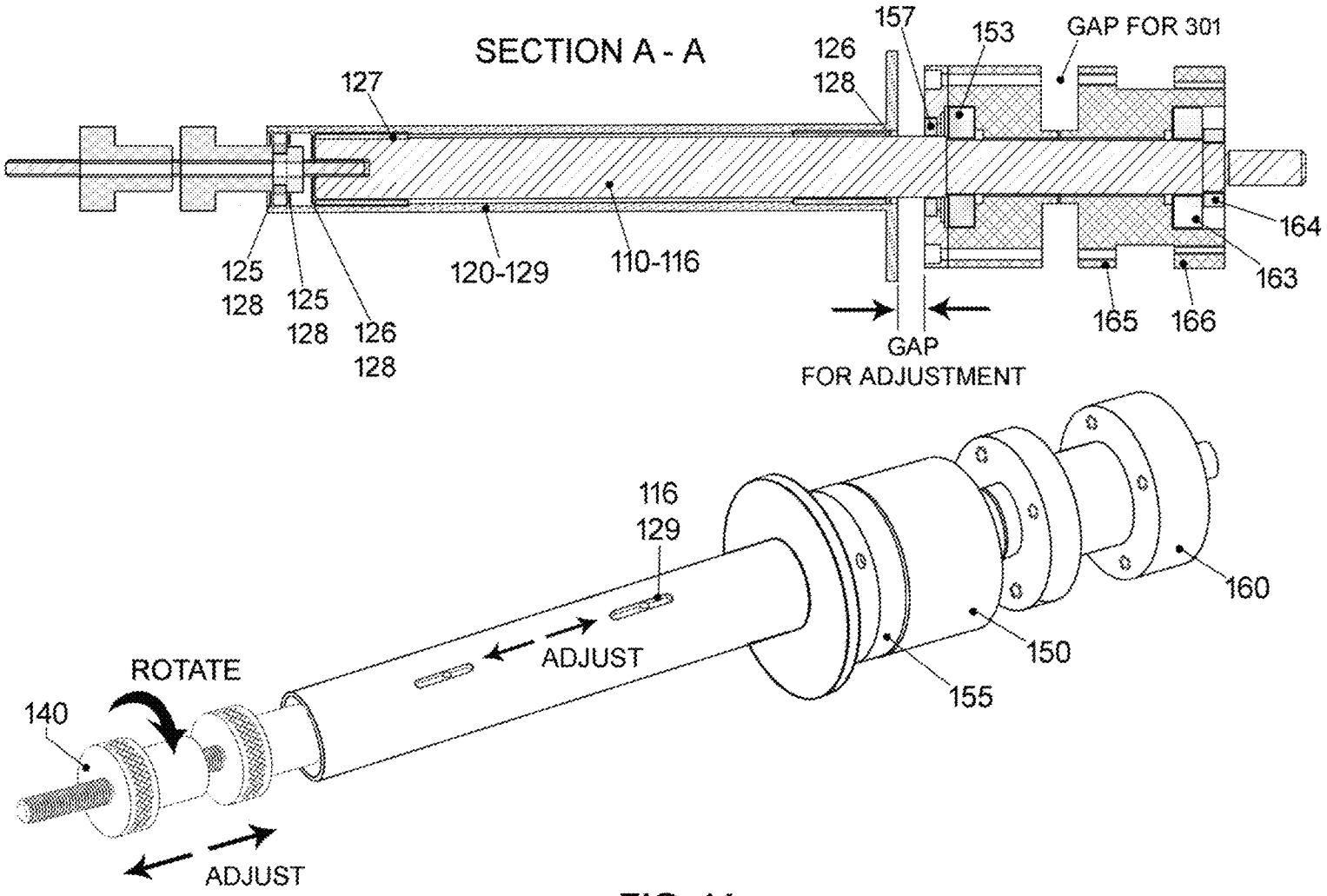
FIG. 14 is the section view (Section A-A) of the of the roll mount, using leaders and descriptive key numbers to show the positioning of the primary components including locations of the adjuster grooves, bearing grooves, and sleeve bearings; in addition, the figure shows that rotation of the adjuster will cause further adjustment of the sleeve subassembly (guided by the two guiding pins in the shaft) which may be moved to take up the gap between the stopper disc and the bearing retaining cover; in accordance with an exemplary embodiment of the present invention.

A plurality of prefabricated openings are created in the machine wall 301. The openings are configured to accepts the features of the internal and external housing subassemblies 150 and 160. As shown in FIG. 14, the internal housing subassembly 150, with the internal housing bearing 153 placed inside the internal housing bearing packet 152, is attached to the conveyor side machine wall 302.

The external housing subassembly 160, with the external housing bearing 163 placed inside the external housing bearing packet 162, is attached to the external side machine wall 303. The bearing retaining cover 155, housing the lip seal 158 inside the seal retaining pocket 157, is attached to the internal housing subassembly 150, using a plurality of machine screws. The lip seal 158 is configured to seal off the access to the internal housing bearing 153, thereby protecting said bearing 153 from the corrosive, environmental elements.

The machine screws are inserted through the counterbored holes 156, the clearances holes 154, and are threaded into the wall flange with threaded holes 165; thereby fixedly attaching the internal housing subassembly 150 to the external housing subassembly 160.

The shaft 110 is inserted into the internal and external housing subassemblies, so that the shaft bearing section 113 (shown in FIG. 8) is protruding in from the internal housing bearing 153, and the shaft second end 114 is protruding out from the external housing bearing 163. Finally, near the shaft second end 114, the bearing retaining collar 164 is inserted onto the shaft 110 and is pushed up against the external housing bearing 163, to keep said bearing 163 firmly in place.

The significant distance between the internal and external housing bearings is the key, functional difference separating any prior art and the present design. The typical horizontal, form, fill and seal packaging machine houses the film feeding station within the frame (defined herein as the machine wall) of the machine. The present design incorporates new bearing blocks, and new brake system, all of which are disposed outside the machine wall. The new brake is more effective and more durable. The enlarged distance between the housing bearings reduces the radial load impacting the shaft, thereby reducing the likelihood of failures caused by the bottom packaging film feeding station.

(2) Attachment of the Sleeve Subassembly.

Figure 8:
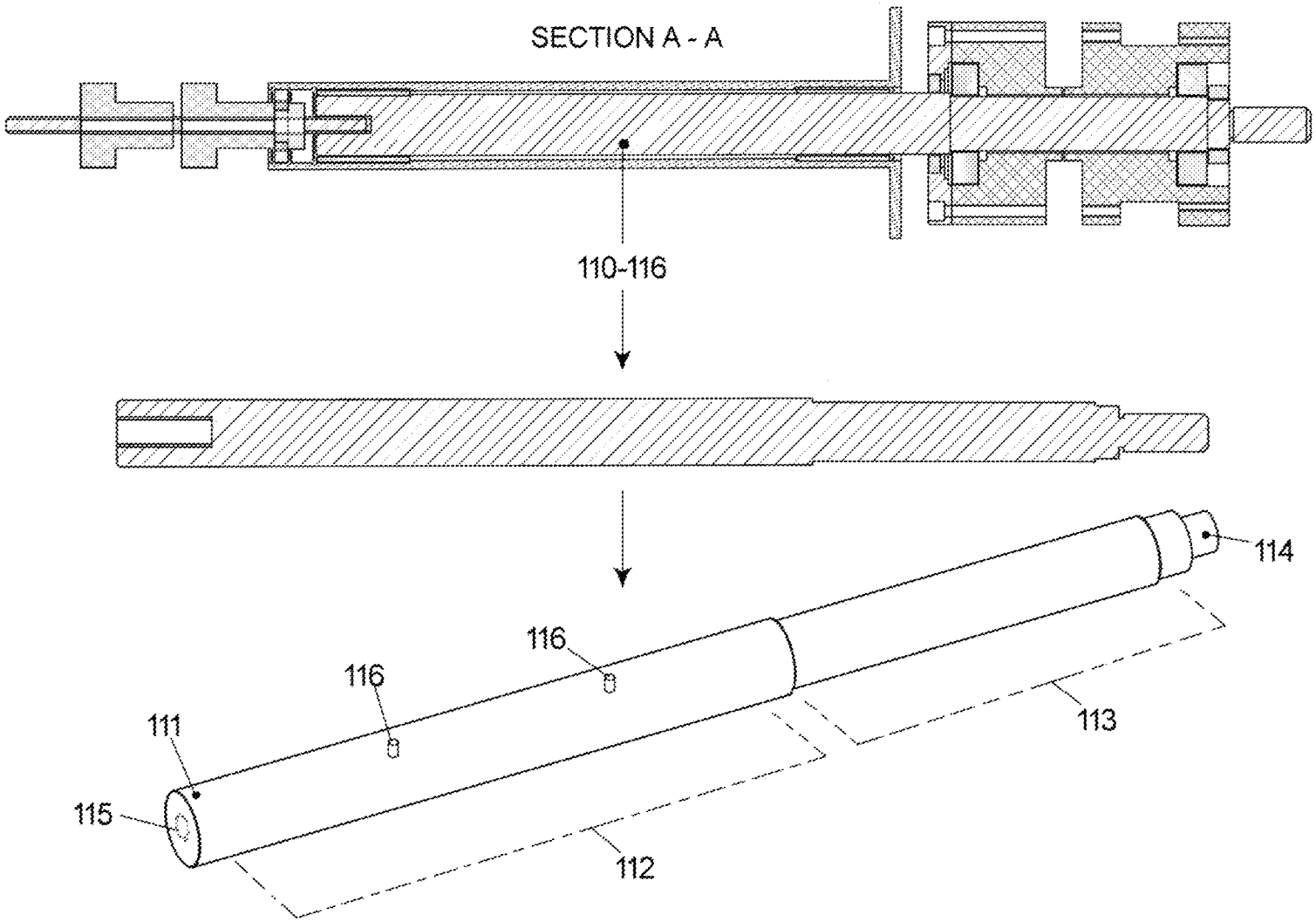
FIG. 8 shows (1) the section view (Section A-A) of the of the roll mount; (2) section view of the shaft; and (3) perspective view of the shaft, wherein leaders and descriptive key numbers are used to further outline its components, including: (a) shaft first end; (b) shaft roll section; (c) shaft bearing section; (d) shaft second end; (e) threaded hole; and (f) two guiding pins; in accordance with an exemplary embodiment of the present invention.

As shown in FIGS. 8 and 14, before the shaft 110 can be placed inside the sleeve subassembly 120, the end-user must remove the two guiding pins 116 from the shaft roll section 112, and place the sleeve bearings inside the sleeve subassembly. One of the sleeve bearings 127 is inserted into the sleeve bearing pocket 127, located at the sleeve first end 121; and one of the sleeve bearings 127 is inserted into the sleeve bearing pocket 127, located at the sleeve second end 123. The sleeve bearings 127 are configured to allow the sleeve subassembly 120 slidably glide on the surface of the shaft 110. Both sleeve bearings 127 are secured in place by using retaining rings 128, which are placed inside the bearing grooves 126 of the sleeve subassembly 120.

Once the sleeve subassembly 120 is inserted over the shaft 110, the two guiding pains 116 are placed back into the shaft 110 through the two guiding slots 129, located at the sleeve midsection 122, as shown in FIGS. 9 and 14. With the pins back inside the shaft midsection 122, the sleeve subassembly 120 is coupled to the shaft 110, such that the sleeve subassembly 120 rotates in unison with the shaft 110 around the shaft axis and moves linearly predetermined distance (or the length of the two guiding slots) along the shaft 110 longitudinal axis.

(3) Attachment of the Air Chuck and the Adjuster Subassembly.

The air chuck 130 is inserted over the sleeve subassembly 120. The final positioning of the air chuck 130 on the sleeve subassembly 120 is configured and adjusted so that the packaging film roll 200 is covering the predetermined area of the chuck 130 and is pushing up against the stopper disc 124, as shown in FIG. 2. Next, the air chuck is connected to a compressor and is activated. When activated, the air chuck expands in diameter thereby releasably-locking the packaging film roll to the sleeve subassembly, enabling the packaging film roll to rotate in unison with the shaft around the shaft axis.

With the shaft 110 and the sleeve subassembly 120 properly coupled to each other, and the air chuck 130 in position, the end-user must attach the adjuster subassembly 140, to the shaft 110 and to the sleeve subassembly 120, as shown in FIG. 14.

Figure 10:
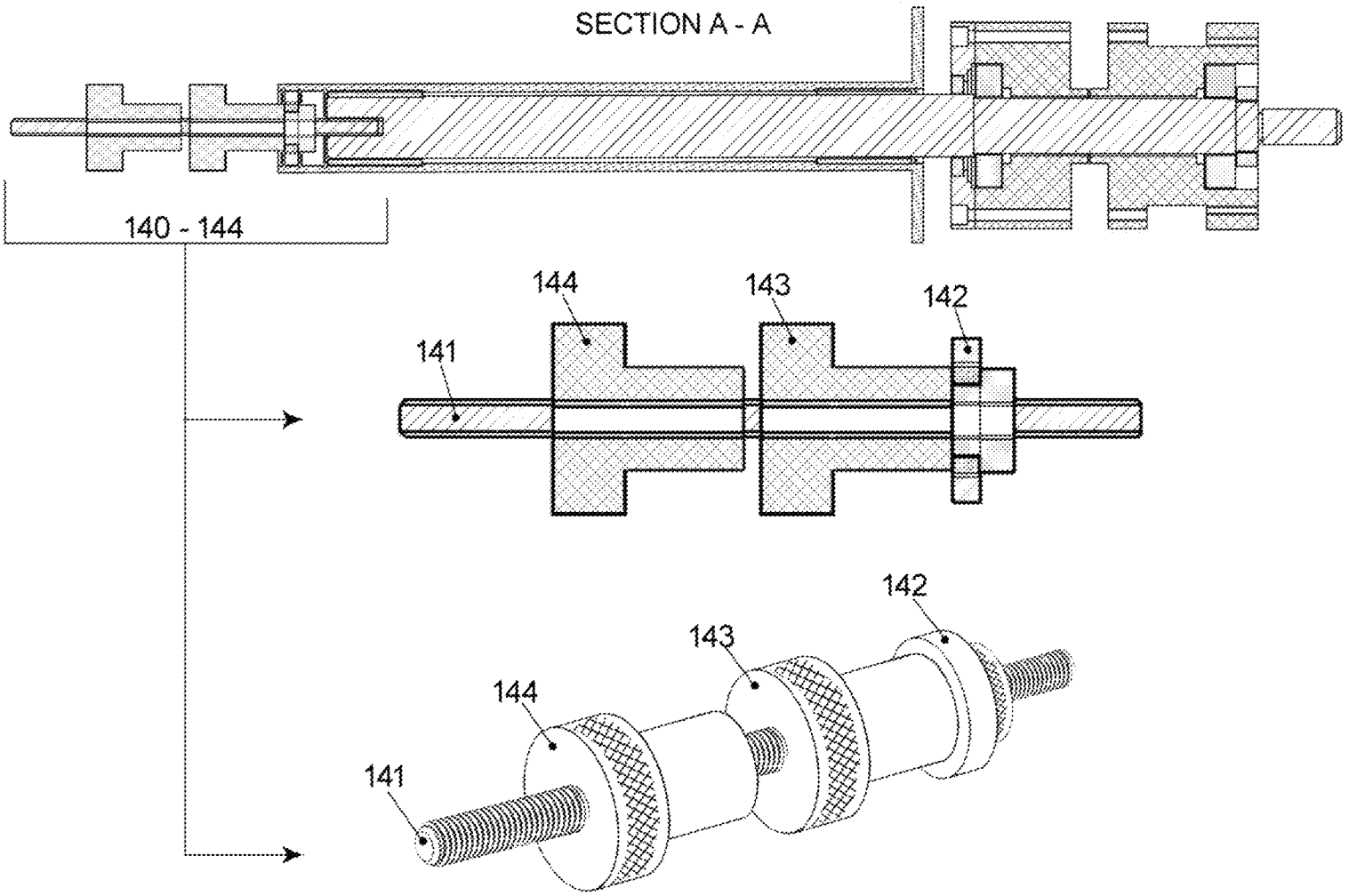
FIG. 10 shows (1) a section view (Section A-A) of the of the roll mount; (2) section view of adjuster subassembly; and (3) a perspective view of the adjuster subassembly, wherein leaders and descriptive key numbers are used to further outline its components, including: (a) threaded rod; (b) bearing ring; (c) adjustment knob; (d) locking knob; in accordance with an exemplary embodiment of the present invention.

Here, the end-user must thread the threaded rod 141 into the threaded hole 115, located in the shaft first end 111. Next, the bearing ring 142 is sandwiched between two retaining rings 128 seated inside the adjuster grooves 125. The adjuster grooves 125 are located inside the sleeve subassembly 120, at the sleeve first end 124, and are easily accessible by the end-user. Once the bearing ring 142 and the threaded rod 141 are in place, the end-user will place on the threaded rod 141 both the adjustment knob 143, and the locking knob 144, as shown in FIG. 10. Here, rotation of the adjustment knob 143 will cause movement of the sleeve subassembly 120 in relation to the shaft 110. This movement is restricted by the two guiding pins 116 located inside the two guiding slots 129. Once the packaging film roll 200 is in a desired location (in relation of the conveying chain 320) the locking knob 144 is spun until it makes contact with the adjusting knob 143. This contact prevents any further movement by the adjustment knob 143, and locks the sleeve subassembly 120 along with the packaging film roll 200 firmly in one place.

(4) Attachment of the Brake.

Figure 13:
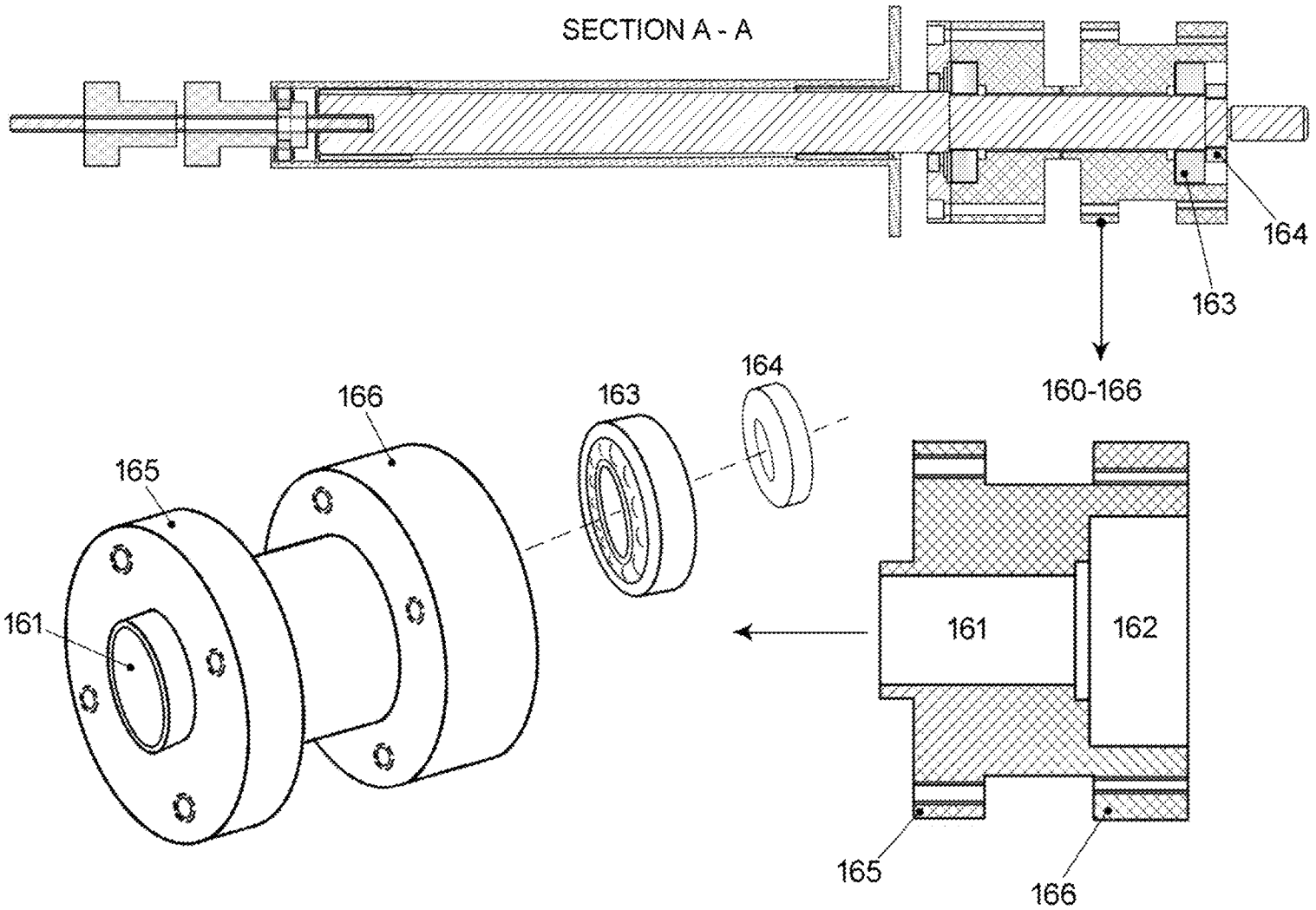
FIG. 13 shows (1) the section view (Section A-A) of the of the roll mount; (2) section view of the external housing subassembly; and (3) perspective view of the external housing subassembly, wherein leaders and descriptive key numbers are used to further outline its components, including: (a) external housing shaft hole; (b) external housing bearing pocket; (c) external housing bearing; (d) bearing retaining collar; (e) wall flange with threaded holes; and (f) brake flange with threaded holes; in accordance with an exemplary embodiment of the present invention.

As shown in FIGS. 2 and 13, the brake 170 is fixedly-attached to the external housing subassembly 160. More specifically, the brake 170 is attached, using a plurality of machine screws, to the brake flange with threaded holes 166. The brake 170 is also controllably coupled to the shaft second end 114, and is configured to stop the rotation of the shaft 110 at predetermined situations. The situations in which the rotation of the shaft 110 must be stopped (and subsequently restarted) relate to maintaining a predetermined amount of tension in the packing film 201 being unspooled from the packaging film roll 200.

(5) Connection of the Roll Mount to the Conveying Chain.

As shown in FIG. 3, all components of the film roller subassembly 180 are attached to the conveyor side machine wall 302. Using the adjuster sub assembly 140, the packaging film roll 200 position is adjusted and aligned with the conveying chain 320. The conveying chain 320 will continuously pull the packaging film 201 causing unspooling of the packaging film 201 from the packaging film roll 200. The first components to control the unspooling firm 201 are the dancer arm 182 and the dance roller 184. The dancer arm 182 is pivotally attached to the arm mounting unit 181. The dancer roller 184, used for tensioning the packaging film 201 unspooling from the packaging film roll 200, is fixedly disposed on the dancer arm 182.

The proximity switch 183 is configured to track location of the dancer arm 182, and based on predetermined positioning of the arm 182, activate the brake 170. The activation of the brake 170 stops the rotation of the packaging film roll 200, which prevents further unspooling of the film 201, which keeps the already unspooled film 201 constantly tensioned by the dancer roller 184. Subsequently, the brake 170 is released and the unspooling of the film 201 continues, until excess of the unspooled packaging film 201 is created, and the brake 170 must be activated once again. This process repeats throughout the machine's operation. From the dancer roller 184, the film 201 is progressed into the stabilizing roller 185.

The stabilizing roller 185 is configured to steer the packaging film 201 unspooling from the packaging film roll 200 into the feeding roller 186. The feeding roller 186 is configured to guide the packaging film 201 unspooling from the packaging film roll 200 into the conveying chain 320. The pressure applied by the dancer roller 184, along with the stabilizing 185 and feeding 186 rollers, ensures that the packing film 201 entering the machine 300 is flat and properly tensioned, which in turn leads to formation of flawless packages.

I claim:

1. A device for mounting, holding, and unspooling a packaging film roll, used in a horizontal, form, fill, and seal packaging machine, comprising:

(A) a shaft, having a shaft first end, a shaft roll section, a shaft bearing section, a shaft second end and a threaded hole disposed in the shaft first end;

(B) a sleeve subassembly, tubular in shape, for holding and adjusting horizontally location of the packaging film roll, having a sleeve first end, a sleeve midsection, a sleeve second end, and a stopper disc;

(C) an adjuster subassembly, attached to the threaded hole, for adjusting positioning and for locking in place the sleeve subassembly and the packaging film roll attached thereto, having a threaded rod, a bearing ring, an adjustment knob, and a locking knob;

(D) an internal housing subassembly, inserted onto the shaft bearing section, for housing an internal housing bearing; said internal housing bearing is configured to enable rotation of the shaft;

(E) an external housing subassembly, inserted onto the shaft bearing section, for housing an external housing bearing; said external housing bearing is configured to enable rotation of the shaft;

(F) a brake, fixedly-attached to the external housing subassembly and controllably coupled to the shaft second end, configured to stop at predetermined situations rotation of the shaft;

(G) a film roller subassembly, fixedly-located on a machine wall of a horizontal, form, fill, and seal packaging machine, for tensioning a packaging film being pulled by a conveying chain and by doing so unspooling the packing film from the packaging film roll;

(H) wherein the internal housing subassembly is fixedly-located on a conveyer side machine wall and the external housing subassembly is fixedly-located on an external side machine wall, thereby substantially separating the internal housing bearing from the external housing bearing;

(I) wherein the machine wall has an opening configured to allow the shaft to be inserted through said opening, so that the shaft bearing section is protruding in from the internal housing bearing and the shaft second end is protruding out from the external housing bearing;

(J) wherein the sleeve subassembly is inserted onto the shaft covering the shaft first end and the shaft roll section;

(K) wherein the sleeve subassembly is coupled to the shaft such that the sleeve subassembly rotates in unison with the shaft around the shaft axis and moves linearly predetermined distance along the shaft longitudinal axis;

(L) a chuck, is inserted onto the sleeve subassembly and the packaging film roll is inserted onto the chuck and pushed until the packaging film roll is urging upon the stopper disc;

(M) wherein said chuck upon application of an external power expands in diameter thereby releasably-locking the packaging film roll to the sleeve subassembly, enabling the packaging film roll to rotate in unison with the shaft around the shaft axis;

(N) wherein the adjustment knob is configured to threadably move by rotating the adjustment knob, and by doing so move the packaging film roll along the shaft longitudinal axis; and (O) wherein the locking knob is configured to threadably move and upon contact with the adjustment knob lock the sleeve subassembly in place along with the packaging film roll attached thereto;

whereby by using the adjuster subassembly the packaging film roll position will be adjusted and aligned with the conveying chain, the conveying chain will continuously pull the packaging film causing unspooling of the packaging film from the packaging film roll, the brake will stop and restart the unspooling allowing the film roller subassembly to keep the packaging film tensioned and flat when entering the horizontal, form, fill, and seal packaging machine.

2. The device for mounting, holding, and unspooling a packaging film roll, used in a horizontal, form, fill, and seal packaging machine of claim 1 wherein: said sleeve subassembly is coupled to the shaft using two guiding pins disposed in the shaft roll section and configured to mesh with correspondingly located two guiding slots disposed on the sleeve midsection.

3. The device for mounting, holding, and unspooling a packaging film roll, used in a horizontal, form, fill, and seal packaging machine of claim 1 wherein: said external power used to expand the chuck is pressurized air.

4. The device for mounting, holding, and unspooling a packaging film roll, used in a horizontal, form, fill, and seal packaging machine of claim 1 wherein: said internal housing bearing is disposed inside an internal housing pocket of the internal housing subassembly.

5. The device for mounting, holding, and unspooling a packaging film roll, used in a horizontal, form, fill, and seal packaging machine of claim 1 wherein: said external housing bearing is disposed inside an external housing pocket of the internal housing subassembly.

6. The device for mounting, holding, and unspooling a packaging film roll, used in a horizontal, form, fill, and seal packaging machine of claim 1 further comprising: a bearing retaining collar for holding the external housing bearing in place.

7. The device for mounting, holding, and unspooling a packaging film roll, used in a horizontal, form, fill, and seal packaging machine of claim 1 further comprising: two adjuster grooves disposed inside the sleeve first end for housing two retaining rings configured to sandwich and thereby hold in place the bearing ring of the adjuster subassembly.

8. The device for mounting, holding, and unspooling a packaging film roll, used in a horizontal, form, fill, and seal packaging machine of claim 1 further comprising: two sleeve bearings for slidably moving the sleeve subassembly on the shaft surface; wherein one of the sleeve bearings is disposed inside the sleeve first end, and one of the sleeve bearings is disposed inside the sleeve second end.

9. The device for mounting, holding, and unspooling a packaging film roll, used in a horizontal, form, fill, and seal packaging machine of claim 8 wherein: said sleeve bearings are fixedly-locked inside said sleeve subassembly by using bearing grooves and disposed therein retaining rings.

10. The device for mounting, holding, and unspooling a packaging film roll, used in a horizontal, form, fill, and seal packaging machine of claim 1 further comprising: an internal housing shaft hole and an external housing shaft hole which are used for housing the shaft bearing section.

11. The device for mounting, holding, and unspooling a packaging film roll, used in a horizontal, form, fill, and seal packaging machine of claim 1 wherein: said brake is fixedly-attached to the external housing subassembly using a plurality of screws threaded to a brake flange with threaded holes.

12. The device for mounting, holding, and unspooling a packaging film roll, used in a horizontal, form, fill, and seal packaging machine of claim 1 further comprising: a bearing retaining cover for holding the internal housing bearing in place.

13. The device for mounting, holding, and unspooling a packaging film roll, used in a horizontal, form, fill, and seal packaging machine of claim 12 wherein: said bearing retaining cover is fixedly-attached to the internal housing subassembly using a plurality of screws disposed inside a plurality of counterbored holes, and corresponding clearance holes, and threaded to a wall flange with threaded holes.

14. The device for mounting, holding, and unspooling a packaging film roll, used in a horizontal, form, fill, and seal packaging machine of claim 12 wherein: said bearing retaining cover further comprises a seal retaining pocket for housing a lip seal.

15. The device for mounting, holding, and unspooling a packaging film roll, used in a horizontal, form, fill, and seal packaging machine of claim 14 wherein: said lip seal is configured to seal off the internal housing bearing from external elements.

16. The device for mounting, holding, and unspooling a packaging film roll, used in a horizontal, form, fill, and seal packaging machine of claim 1 wherein: said film roller subassembly is further comprising an arm mounting unit, a dancer arm, a dancer roller, a stabilizing roller, a feeding roller, and a proximity switch.

17. The device for mounting, holding, and unspooling a packaging film roll, used in a horizontal, form, fill, and seal packaging machine of claim 16 wherein: said dancer arm is pivotally located on the arm mounting unit; the dancer roller for tensioning the packaging film unspooling from the packaging film roll, is fixedly disposed on the dancer arm.

18. The device for mounting, holding, and unspooling a packaging film roll, used in a horizontal, form, fill, and seal packaging machine of claim 17 wherein: said proximity switch is configured to track location of the dancer arm and at predetermined location activate the brake stopping rotation of the packaging film roll thereby keeping the packaging film unspooling from the packaging film roll constantly tensioned.

19. The device for mounting, holding, and unspooling a packaging film roll, used in a horizontal, form, fill, and seal packaging machine of claim 18 wherein: said stabilizing roller is configured to steer the packaging film unspooling from the packaging film roll into the feeding roller.

20. The device for mounting, holding, and unspooling a packaging film roll, used in a horizontal, form, fill, and seal packaging machine of claim 19 wherein: said feeding roller is configured to guide the packaging film unspooling from the packaging film roll into the conveying chain.

* * * * *